US012807196B2

(12) United States Patent
Chouno et al.

(10) Patent No.: US 12,807,196 B2
(45) Date of Patent: Nov. 24, 2026

(54) RAIL VEHICLE

(71) Applicant: Hitachi, Ltd., Tokyo (JP)

(72) Inventors: Takahiro Chouno, Tokyo (JP); Takamasa Iwamoto, Tokyo (JP); Yuuki Hashimoto, Tokyo (JP); Yoshiaki Sugii, Tokyo (JP); Yuya Futamura, Tokyo (JP); Katsunari Kohashi, Tokyo (JP); Rikuto Yatabe, Tokyo (JP); Hiroki Tsunoda, Aichi (JP); Ryutaro Imakoma, Aichi (JP)

(73) Assignee: Hitachi, Ltd., Tokyo (JP)

( * ) Notice: Subject to any disclaimer, the term of this patent is extended or adjusted under 35 U.S.C. 154(b) by 386 days.

(21) Appl. No.: 18/598,347

(22) Filed: Mar. 7, 2024

(65) Prior Publication Data

US 2024/0300554 A1 Sep. 12, 2024

(30) Foreign Application Priority Data

Mar. 8, 2023 (JP) ..... 2023-035351

(51) Int. Cl.
*B61D 49/00* (2006.01)

(52) U.S. Cl.
CPC ..... *B61D 49/00* (2013.01)

(58) Field of Classification Search
CPC ..... B61D 17/00; B61D 17/12; B61D 17/18; B61D 17/185; B61D 49/00
See application file for complete search history.

(56) References Cited

FOREIGN PATENT DOCUMENTS

JP 2019214269 A * 12/2019 ..... B61D 17/18

* cited by examiner

*Primary Examiner* — Robert J McCarry, Jr.
(74) *Attorney, Agent, or Firm* — Crowell & Moring LLP

(57) ABSTRACT

Provided is a rail vehicle including a film that can be maintained in a construction state without being affected by expansion and contraction or the like of the film due to aging, and can be easily constructed and replaced, in addition to being able to promote a weight reduction by reducing the number of components. In a rail vehicle including a structure, the structure includes a film provided along the structure on a vehicle inner side of the rail vehicle, the film has a film central portion, a film end portion connected to the structure via an elastic body, and a first fastener portion that separably connects the film central portion and the film end portion, and tension of the elastic body is applied to the film in a state in which the first fastener portion is closed.

9 Claims, 12 Drawing Sheets

RAIL VEHICLE

CROSS-REFERENCE TO RELATED APPLICATIONS

The present application claims priority to Japanese Patent Application No. 2023-035351, filed Mar. 8, 2023. The contents of this application are incorporated herein by reference in their entirety.

TECHNICAL FIELD

The present invention relates to a rail vehicle.

BACKGROUND ART

A rail vehicle operated along a laid track generally has a hexahedral rail vehicle structure including an underframe serving as a floor surface, end structures erected on both end portions in a longitudinal direction of the underframe, side structures erected on both end portions in a width direction of the underframe, and a roof structure placed on upper end portions of the end structures and the roof structure. An upper floor is provided on an upper surface of the underframe, and a seat or the like is provided on an upper surface of the upper floor. A heat insulating material and a sound insulating material are provided on a vehicle inner side of the side structures and the roof structure, and interior materials such as a side material and a ceiling material are provided in a manner of covering the heat insulating material and the sound insulating material, thereby providing a comfortable vehicle interior environment.

PTL 1 discloses a rail vehicle that can reduce the number of components, can reduce manufacturing steps related to work of positioning side structures, a roof structure, and an interior material, and has a light interior material. Such a rail vehicle includes an underframe, an upper floor that is provided on an upper surface of the underframe and serves as a floor portion, side structures erected on end portions in a width direction of the underframe, a roof structure placed on upper end portions of the side structures, side films provided on a vehicle inner side of the side structures, and a ceiling film provided on a vehicle inner side of the roof structure.

CITATION LIST

Patent Literature

PTL 1: JP2019-214269A

SUMMARY OF INVENTION

Technical Problem

According to the rail vehicle, the rail vehicle includes the side films that function as interior materials provided on the vehicle inner side of the side structures, and the ceiling film that functions as an interior material provided on the vehicle inner side of the roof structure, and thus the rail vehicle can reduce the number of components and contribute to a weight reduction. However, there is a concern that a state at the time of construction (immediately after manufacturing) cannot be maintained because a film expands and contracts due to an influence of aging or vehicle inner temperature and humidity. In addition, it is desired to provide a configuration in which the film can be easily replaced when there is a damage due to operation or deterioration such as contamination or discoloration caused by aging.

An object of the invention is to provide a rail vehicle including a film that can be maintained in a construction state without being affected by expansion and contraction or the like of the film due to aging, and can be easily constructed and replaced, in addition to being able to promote a weight reduction by reducing the number of components.

Solution to Problem

In order to solve the above problems, a typical rail vehicle of the invention is a rail vehicle including a structure, in which the structure includes a film provided along the structure on a vehicle inner side of the rail vehicle, the film has a film central portion, a film end portion connected to the structure via an elastic body, and a first fastener portion that separably connects the film central portion and the film end portion, and tension of the elastic body is applied to the film in a state in which the first fastener portion is closed.

Advantageous Effects of Invention

According to the invention, it is possible to provide a rail vehicle including a film that can be maintained in a construction state without being affected by expansion and contraction or the like of the film due to aging, and can be easily constructed and replaced, in addition to being able to promote a weight reduction by reducing the number of components.

Problems, configurations, and effects other than those described above will become apparent by description of the following embodiments.

DESCRIPTION OF EMBODIMENTS

Hereinafter, embodiments of a rail vehicle according to the invention will be described with reference to the drawings. First, directions are defined in order to describe a configuration of a rail vehicle. A longitudinal direction of the rail vehicle is defined as an x direction, a width direction of the rail vehicle is defined as a y direction, and a height direction of the rail vehicle is defined as a z direction. Hereinafter, directions may be simply referred to as the x direction, the y direction, and the z direction.

The rail vehicle is a vehicle operated along a laid track, and includes a railway vehicle, a monorail vehicle, a new transportation system vehicle, a streetcar, or the like. Hereinafter, a railway vehicle will be described as a representative example of a rail vehicle. A "structure" simply includes an end structure, a side structure, a roof structure, and the like, and a "film" includes a ceiling film, a side film, and the like.

Figure 1:
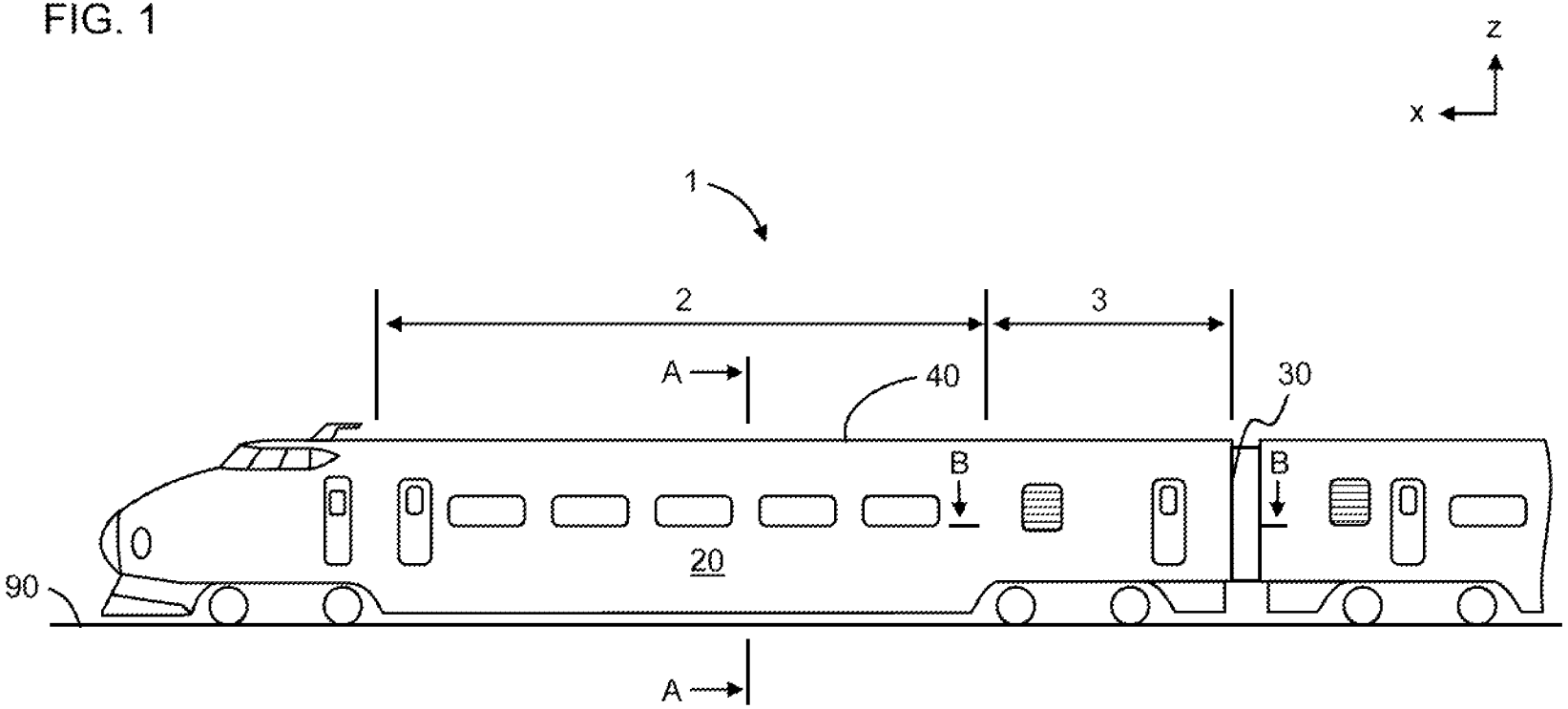
FIG. 1 is a side view showing a railway vehicle.
Figure 2:
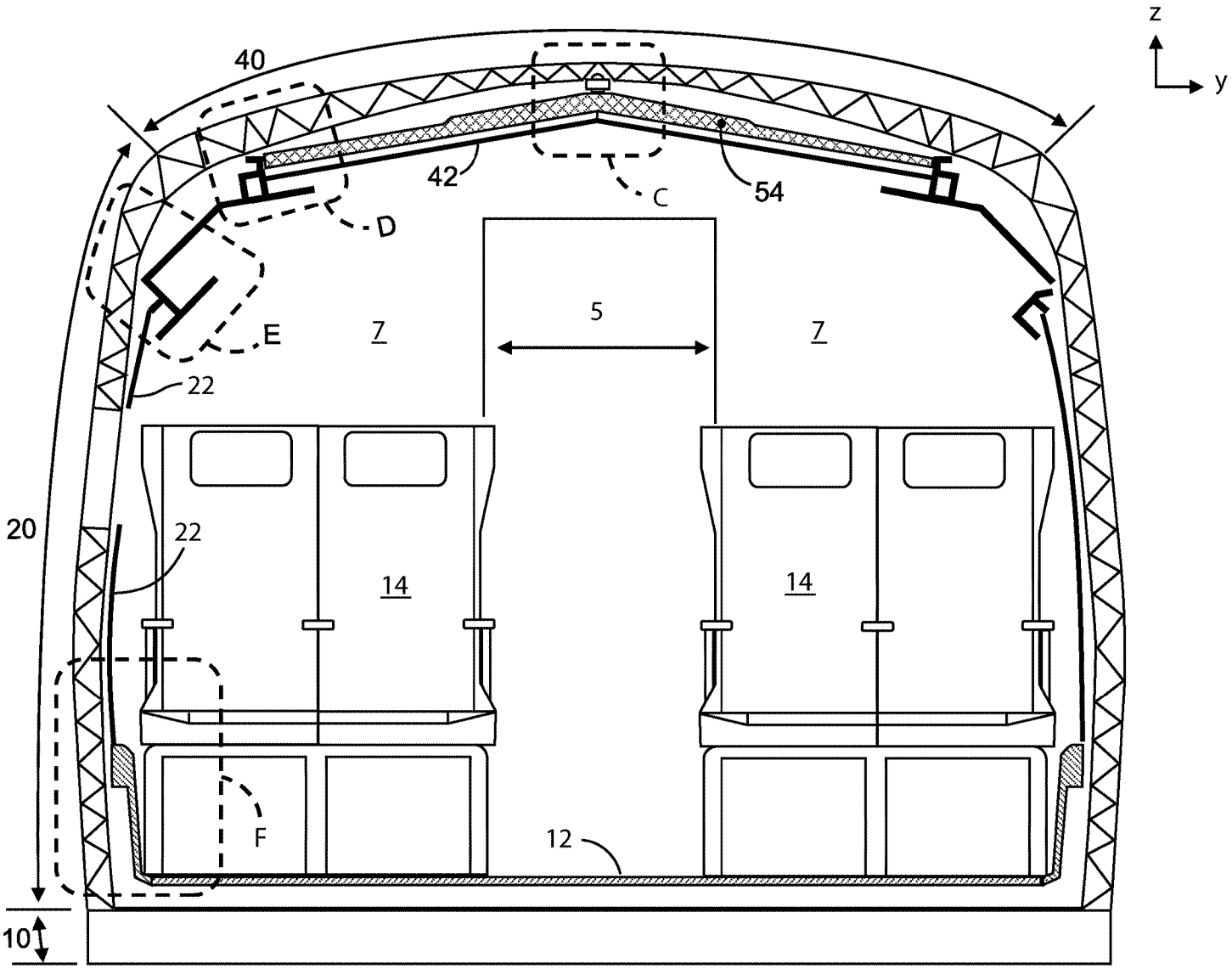
FIG. 2 is a cross-sectional view (a cross-sectional view taken along a line A-A in FIG. 1) intersecting a longitudinal direction of the railway vehicle.

FIG. 1 is a side view showing a railway vehicle, and FIG. 2 is a cross-sectional view (a cross-sectional view taken along a line A-A in FIG. 1) intersecting a longitudinal direction of the railway vehicle. A railway vehicle 1 includes a hexahedral railway vehicle structure including an underframe 10 serving as a floor surface, side structures 20 erected on both end portions in the y direction of the underframe 10, an end structure 30 erected on an end portion in the x direction of the underframe 10, and a roof structure 40 placed on upper end portions of the side structures 20 and the end structure 30, and the railway vehicle 1 includes a pair of bogies (not shown) that supports lower surfaces of both end portions in the x direction of the railway vehicle structure. The bogie supports the railway vehicle structure and moves along a track 90.

The railway vehicle 1 includes a cabin portion 2 at a central portion in the x direction of the railway vehicle 1 in which a passenger or the like boards the vehicle, and a vehicle end portion 3 that is continuous with the cabin portion 2 and is positioned at an end portion in the x direction of the railway vehicle 1. The vehicle end portion 3 includes various devices. A vehicle-end-portion passage 5 (see FIG. 7) through which a crew member or the like can come and go is provided along the x direction at a central portion in the y direction of the vehicle end portion 3.

The cabin portion 2 of the railway vehicle 1 has an upper floor 12 on an upper surface of the underframe 10, and seats 14 are provided on an upper surface of the upper floor 12. A heat insulating material 52, a sound absorbing material 54, and a ceiling film 42 are provided in this order from a vehicle inner side plate 40*b* side of the roof structure 40 on a vehicle inner side of the roof structure 40 (see FIG. 3). Similarly, the heat insulating material 52, the sound absorbing material 54, and a side film 22 are provided in this order from a vehicle inner side plate 20*b* side of the side structure 20 (see FIG. 5).

<Configuration of Ceiling Portion of Railway Vehicle>

Figure 3:
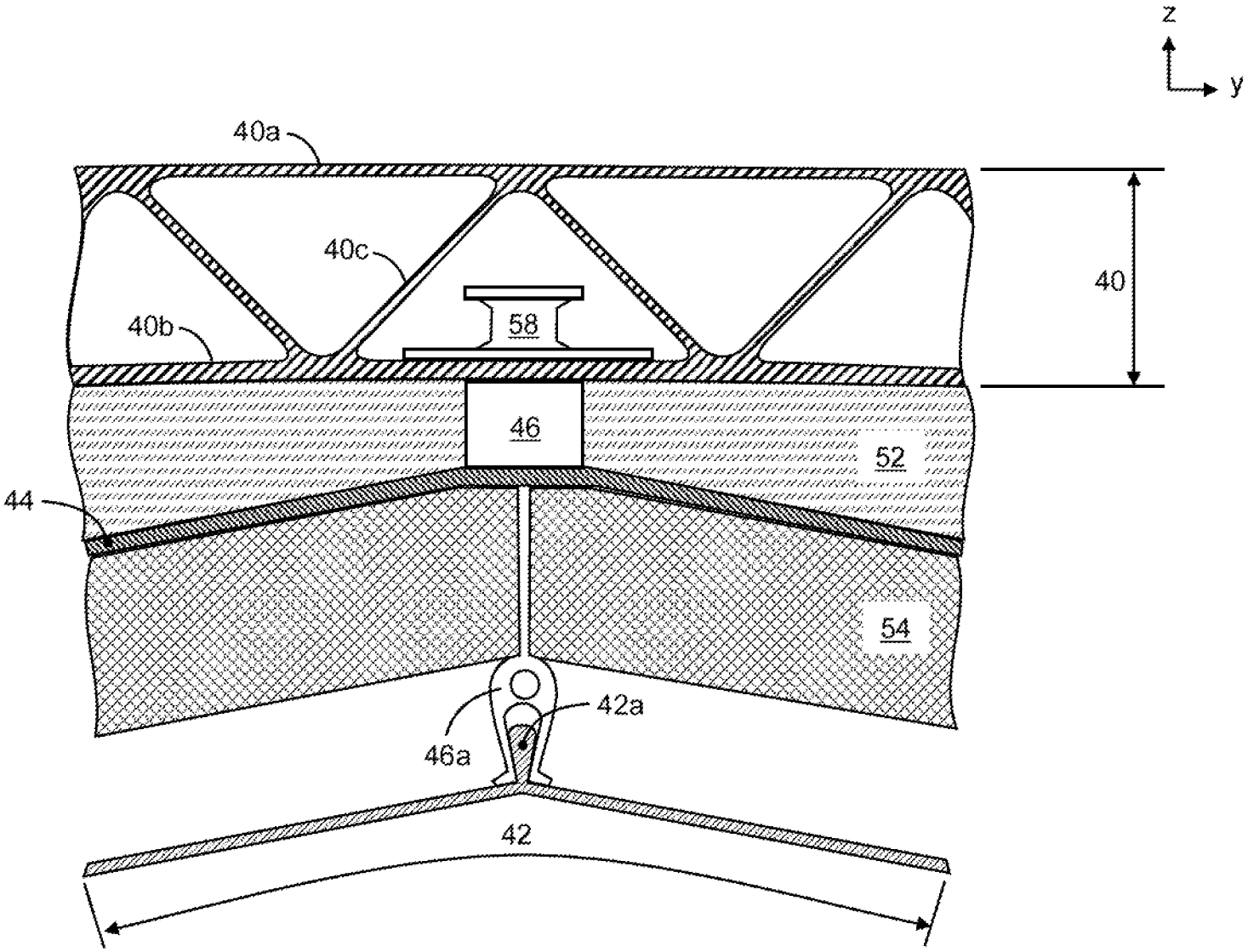
FIG. 3 is a cross-sectional view (a part C in FIG. 2) showing a central portion of a roof structure and intersecting the longitudinal direction of the railway vehicle.
Figure 4:
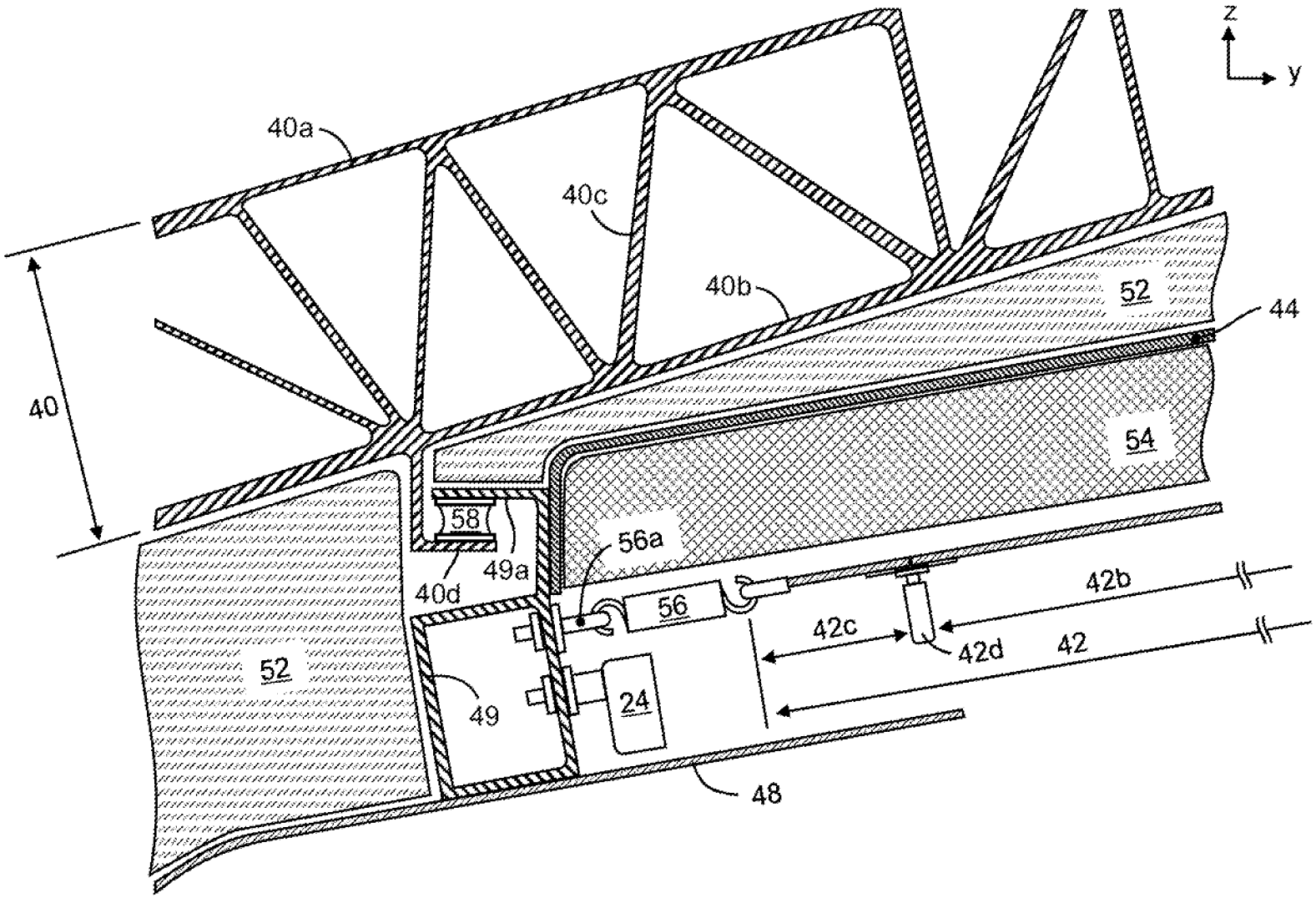
FIG. 4 is a cross-sectional view (a part D in FIG. 2) showing an end portion in a width direction of the roof structure and intersecting the longitudinal direction of the railway vehicle.

FIG. 3 is a cross-sectional view (a part C in FIG. 2) showing a central portion of the roof structure and intersecting the longitudinal direction of the railway vehicle, and FIG. 4 is a cross-sectional view (a part D in FIG. 2) showing an end portion in a width direction of the roof structure and intersecting the longitudinal direction of the railway vehicle. The roof structure 40 is formed of a hollow extruded member that is extruded in the x direction and includes a vehicle external side plate 40*a*, the vehicle inner side plate 40*b*, and a plurality of connection ribs 40*c* that connect both of the side plates.

In FIG. 3, the heat insulating material 52, a first sound absorbing material support plate 44, the sound absorbing material 54, and the ceiling film 42 are provided in this order on the vehicle inner side of the roof structure 40. The heat insulating material 52 is provided in contact with the vehicle inner side plate 40*b*.

The vehicle inner side plate 40*b* at the central portion in the y direction of the roof structure 40 is provided with a central portion holding portion 46 that hangs down toward the vehicle inner side via a vibration-proof rubber 58. The central portion holding portion 46 holds the first sound absorbing material support plate 44 at a central portion in the z direction of the first sound absorbing material support plate 44, and a gripping portion 46*a* that passes through the sound absorbing material 54 is provided at a lower end portion in the z direction of the central portion holding portion 46. The gripping portion 46*a* is a pair of claws that grips, from both sides in the y direction, a ceiling film central protrusion portion 42*a* connected to a central portion in the y direction of the ceiling film 42. The ceiling film central protrusion portion 42*a* has a shape in which a width in the y direction increases upward in the z direction. Therefore, the ceiling film 42 can be assembled without using a tool by inserting the ceiling film central protrusion portion 42*a* into the gripping portion 46*a* from below in the z direction.

A central portion in the y direction of the first sound absorbing material support plate 44 is connected to the central portion holding portion 46 supported by the roof structure 40 in a vibration proof manner, and an end portion in the y direction of the first sound absorbing material support plate 44 is connected to a first film and sound absorbing material support portion 49 supported by the roof structure 40 in a vibration proof manner (see FIG. 4).

The first film and sound absorbing material support portion 49 includes a rectangular cross-section portion, an extending portion extending in the z direction from one surface of the rectangular cross-section portion, and a horizontal portion 49*a* extending in the y direction from an end portion in the z direction of the extending portion. The horizontal portion 49*a* is supported by a receiving portion 40*d* in a vibration proof manner via the vibration-proof rubber 58, and the receiving portion 40*d* has an L-shaped cross section and is connected to the vehicle inner side plate 40*b* of the roof structure 40. The receiving portion 40*d* may be integrally extrusion-molded with the roof structure 40, or may be formed by another component independent of the roof structure 40. The first film and sound absorbing material support portion 49 may be provided with a lamp 24.

The ceiling film 42 has a ceiling film central portion 42*b* at the central portion in the y direction of the ceiling film 42 and ceiling film end portions 42*c* that are end portions in the y direction of the ceiling film 42. The ceiling film central portion 42*b* and the ceiling film end portion 42*c* are connected to each other via a fastener portion (also referred to as a first fastener portion) 42*d* that can be opened, closed, and separated.

As described above, the ceiling film 42 has the ceiling film central protrusion portion 42*a* that is connected to the ceiling film 42 at the central portion in the y direction of the ceiling film 42 and protrudes toward the roof structure 40 side, and the ceiling film central protrusion portion 42*a* is gripped by the gripping portion 46*a* of the central portion holding portion 46.

An end portion in the y direction of the ceiling film end portion 42*c* (an end portion on an opposite side of the fastener portion 42*d*) is connected to one end portion of an elastic body 56 which is, for example, a coil spring, and the other end portion of the elastic body 56 is connected to the first film and sound absorbing material support portion 49 via an elastic body support portion 56*a*. The ceiling film 42 is provided in the railway vehicle 1 in a state of being constantly stretched by elastic force of the elastic body 56 (a state in which tension is applied in the y direction) when the fastener portion 42*d* is closed.

The first sound absorbing material support plate 44 and the ceiling film 42 that occupy a large area on the vehicle inner side of the roof structure 40 are both supported by the central portion holding portion 46 supported by the roof structure 40 in a vibration proof manner and the first film and sound absorbing material support portion 49 supported by the roof structure 40 in a vibration proof manner.

<Effects>

Since a ceiling of the railway vehicle 1 is covered with the ceiling film 42 having a small number of components, easy construction can be achieved with a small number of manufacturing steps. Further, since the ceiling film central portion 42*b* and the ceiling film end portion 42*c* of the ceiling film 42 are connected to each other via the fastener portion 42*d*, only the ceiling film central portion 42*b* can be easily replaced by opening, closing, and separating the fastener portion 42*d* when the ceiling film 42 needs to be replaced due to deterioration or the like caused by aging.

Further, the ceiling film 42 can be maintained in a constantly stretched state by supporting both end portions in the y direction of the ceiling film 42 with the elastic bodies 56. Therefore, even when the ceiling film 42 expands and contracts due to aging or a change in a vehicle interior temperature, a state in which the ceiling film 42 is constructed (a state at the time of being newly manufactured) can be constantly maintained.

Further, the roof structure 40 may be excited to vibrate due to a vehicle external pressure fluctuation when the railway vehicle 1 travels at high speed or passes an oncoming vehicle in a tunnel. In such a case, since the first sound absorbing material support plate 44 and the ceiling film 42 are also supported by the roof structure 40 in a vibration proof manner, vibrations of the first sound absorbing material support plate 44 and the ceiling film 42 are prevented, and an increase in vehicle interior noises can be prevented.

According to the above configuration, it is possible to provide a rail vehicle including a film that can prevent an increase in vehicle interior noises during high-speed traveling, can maintain a construction state without being affected by expansion and contraction or the like of the film due to aging, and further can be easily constructed and replaced, in addition to being able to promote a weight reduction by reducing the number of components.

<Configuration of Side Portion of Railway Vehicle>

Figure 5:
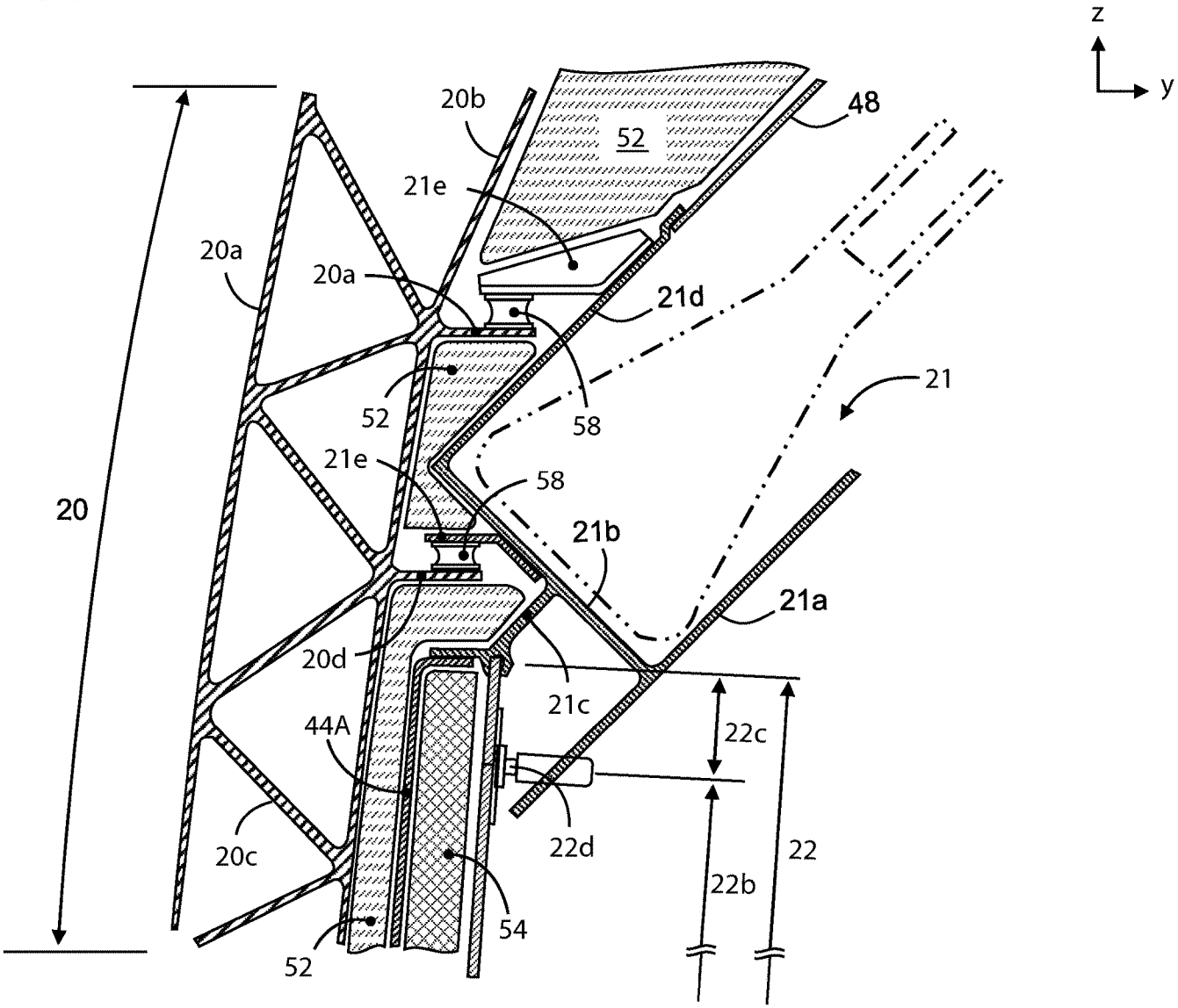
FIG. 5 is a cross-sectional view (a part E in FIG. 2) showing an upper end portion in a height direction of a side structure and intersecting the longitudinal direction of the railway vehicle.
Figure 6:
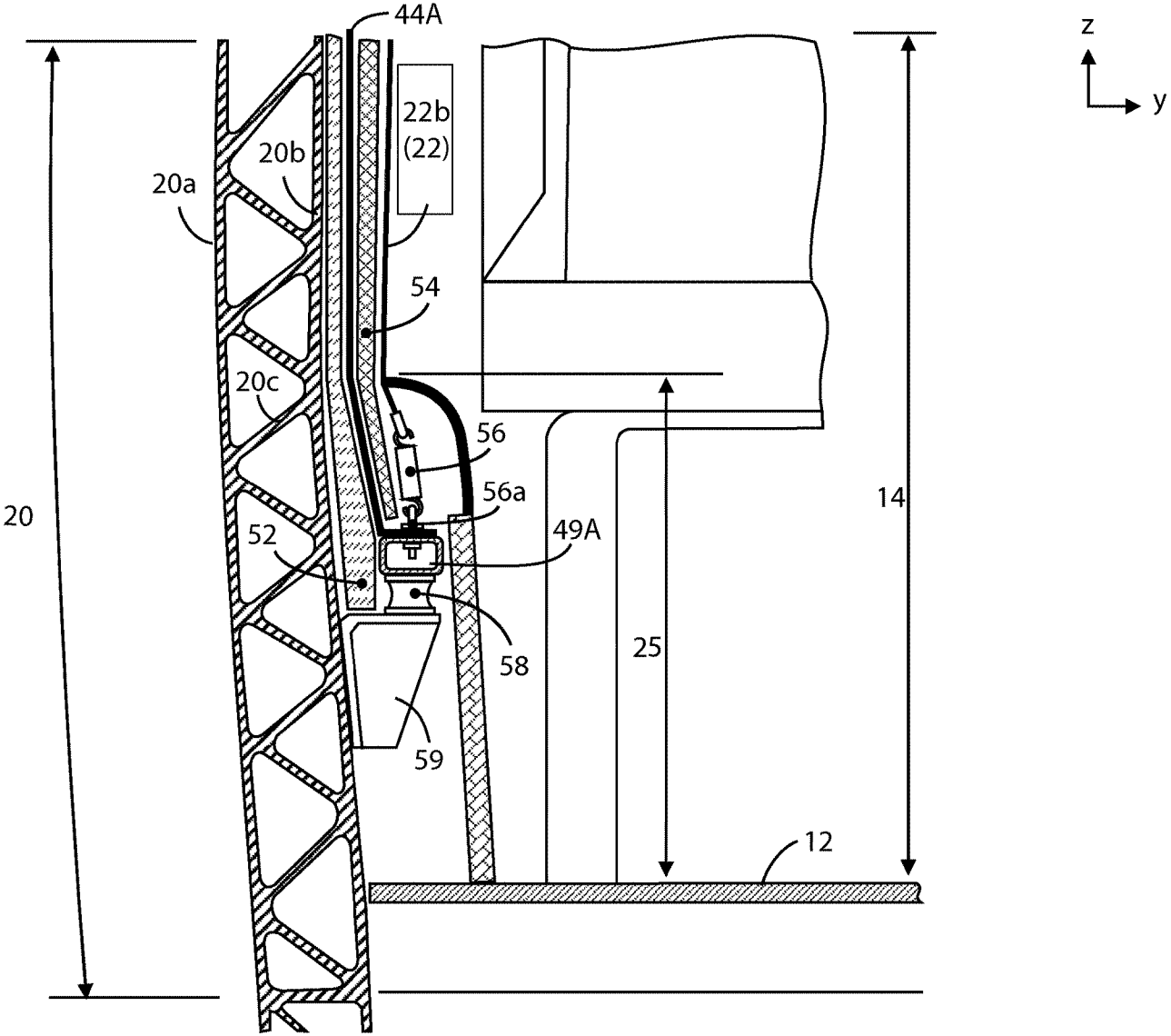
FIG. 6 is a cross-sectional view (a part F in FIG. 2) showing a lower end portion in the height direction of the side structure and intersecting the longitudinal direction of the railway vehicle.

FIG. 5 is a cross-sectional view (a part E in FIG. 2) showing an upper end portion in a height direction of the side structure and intersecting the longitudinal direction of the railway vehicle, and FIG. 6 is a cross-sectional view (a part F in FIG. 2) showing a lower end portion in the height direction of the side structure and intersecting the longitudinal direction of the railway vehicle.

The side structure 20 is formed of a hollow extruded member that is extruded in the x direction and includes a vehicle external side plate 20*a*, the vehicle inner side plate 20*b*, and a plurality of connection ribs 20*c* that connect both of the side plates.

The heat insulating material 52, a second sound absorbing material support plate 44A, the sound absorbing material 54, and the side film 22 are provided in this order on a vehicle inner side of the side structure 20. The heat insulating material 52 is fixed to the vehicle inner side plate 20*b*.

A receiving portion 20*d* in a state of extending horizontally toward the vehicle inner side is provided on the vehicle inner side plate 20*b* at an upper end portion in the z direction of the side structure 20. The receiving portion 20*d* may be integrally extrusion-molded with the side structure 20, or may be formed by another component independent of the side structure 20.

A luggage receiving portion 21 is provided on a vehicle inner side of a connection portion (an eaves portion) between an upper end portion of the side structure 20 and an end portion in the y direction of the roof structure 40 (see FIG. 2). The luggage receiving portion 21 includes a luggage receiving portion bottom portion 21*b*, a luggage receiving portion back side panel 21*d* erected on one end portion in the y direction of the luggage receiving portion bottom portion 21*b*, and a luggage receiving portion front side panel 21*a* erected on the other end portion in the y direction of the luggage receiving portion bottom portion 21*b*. The luggage receiving portion front side panel 21*a* passes by the luggage receiving portion bottom portion 21*b* and extends obliquely downward in the z direction from an upper end of the side film 22.

A luggage receiving portion support portion 21*e* is provided on a vehicle external side of the luggage receiving portion back side panel 21*d*. Similarly, the luggage receiving portion support portion 21*e* and a second film and sound absorbing material support portion 21*c* are provided below (in the −z direction) the luggage receiving portion bottom portion 21*b*. The second film and sound absorbing material support portion 21*c* extends parallel to the luggage receiving portion front side panel 21*a* and is shorter than the luggage receiving portion front side panel 21*a* (by approximately a half-length).

Two luggage receiving portion support portions 21*e* are connected to the luggage receiving portion 21, and the luggage receiving portion 21 is supported in a vibration proof manner by the two luggage receiving portion support portions 21*e* via the respective vibration-proof rubbers 58 on the receiving portion 20*d* connected to the vehicle inner side plate 20*b* of the side structure 20.

One end portion of an eaves portion interior panel 48 is connected to an upper end portion of the luggage receiving portion back side panel 21*d*. The other end portion of the eaves portion interior panel 48 is fixed to the first film and sound absorbing material support portion 49 supported by the roof structure 40 in a vibration proof manner (see FIG. 4). That is, the eaves portion interior panel 48 is supported in a vibration proof manner relative to the roof structure 40 and the side structure 20.

As shown in FIG. 6, a vibration-proof rubber support portion 59 is provided on the vehicle inner side of a lower end portion in the z direction of the side structure 20 (the vehicle inner side plate 20*b*), and a third film and sound absorbing material support portion 49A is supported in a vibration proof manner on an upper surface of the vibration-proof rubber support portion 59 via the vibration-proof rubber 58. The vibration-proof rubber support portion 59 may be integrally extrusion-molded with the side structure 20, or may be formed by another component independent of the side structure 20.

An upper end portion of the second sound absorbing material support plate 44A provided in the z direction along the side structure 20 is connected to the second film and sound absorbing material support portion 21*c* supported by the side structure 20 in a vibration proof manner (see FIG. 5), and a lower end portion of the second sound absorbing material support plate 44A is connected to the third film and sound absorbing material support portion 49A supported by the side structure 20 (the vibration-proof rubber support portion 59) in a vibration proof manner via the vibration-proof rubber 58.

The side film 22 has a side film central portion 22*b* at a central portion in the z direction of the side film 22 and side film end portions 22*c* at end portions in the z direction of the side film 22. The side film central portion 22*b* and the side film end portion 22*c* are connected via a fastener portion (also referred to as a first fastener portion) 22*d* that can be opened, closed, and separated.

The side film end portion 22*c* at an upper end portion of the side film 22 is connected to the second film and sound absorbing material support portion 21*c* supported by the side structure 20 in a vibration proof manner, and similarly, the side film end portion 22*c* at a lower end portion of the side film 22 is connected, via the elastic body 56, to the third film and sound absorbing material support portion 49A supported by the side structure 20 in a vibration proof manner. The side film 22 is provided in the railway vehicle 1 in a state of being constantly stretched by elastic force of the elastic body 56 (a state in which tension is applied) when the fastener portion 22*d* is closed.

That is, upper end portions in the z direction of both the second sound absorbing material support plate 44A and the side film 22 that occupy a large area on the vehicle inner side of the side structure 20 are connected to the second film and sound absorbing material support portion 21*c* supported by the side structure 20 in a vibration proof manner, and lower end portions in the z direction of the second sound absorbing material support plate 44A and the side film 22 are connected to the third film and sound absorbing material support portion 49A supported by the side structure 20 in a vibration proof manner.

<Effects>

Since a side surface on the vehicle inner side of the railway vehicle 1 is covered with the side film 22 having a small number of components, easy construction can be achieved with a small number of manufacturing steps. Further, since the side film 22 is implemented by connecting the side film central portion 22*b* and the side film end portion 22*c* via the fastener portion 22*d*, only the side film central portion 22*b* can be easily replaced by opening, closing, and separating the fastener portion 22*d* when the side film 22 needs to be replaced due to deterioration or the like caused by aging.

Further, the side film 22 can be maintained in a constantly stretched state by supporting end portions in the z direction of the side film 22 with the elastic bodies 56. Therefore, even when the side film 22 expands and contracts due to aging or a change in a vehicle interior temperature, a state in which the side film 22 is constructed can be constantly maintained.

Further, the side structure 20 may be excited to vibrate due to a vehicle external pressure fluctuation when the railway vehicle 1 travels at high speed or passes an oncoming vehicle in a tunnel. Even in this case, since the second sound absorbing material support plate 44A, the side film 22, and the luggage receiving portion 21 are supported by the side structure 20 in a vibration proof manner, vibrations of the second sound absorbing material support plate 44A, the side film 22, and the luggage receiving portion 21 are reduced, and thus an increase in vehicle interior noises can be prevented.

According to the above configuration, it is possible to provide a rail vehicle including a film that can prevent an increase in vehicle interior noises during high-speed traveling, can maintain a construction state without being affected by expansion and contraction or the like of the film due to aging, and further can be easily constructed and replaced, in addition to being able to promote a weight reduction by reducing the number of components.

<Configuration of Vehicle End Portion>

Figure 7:
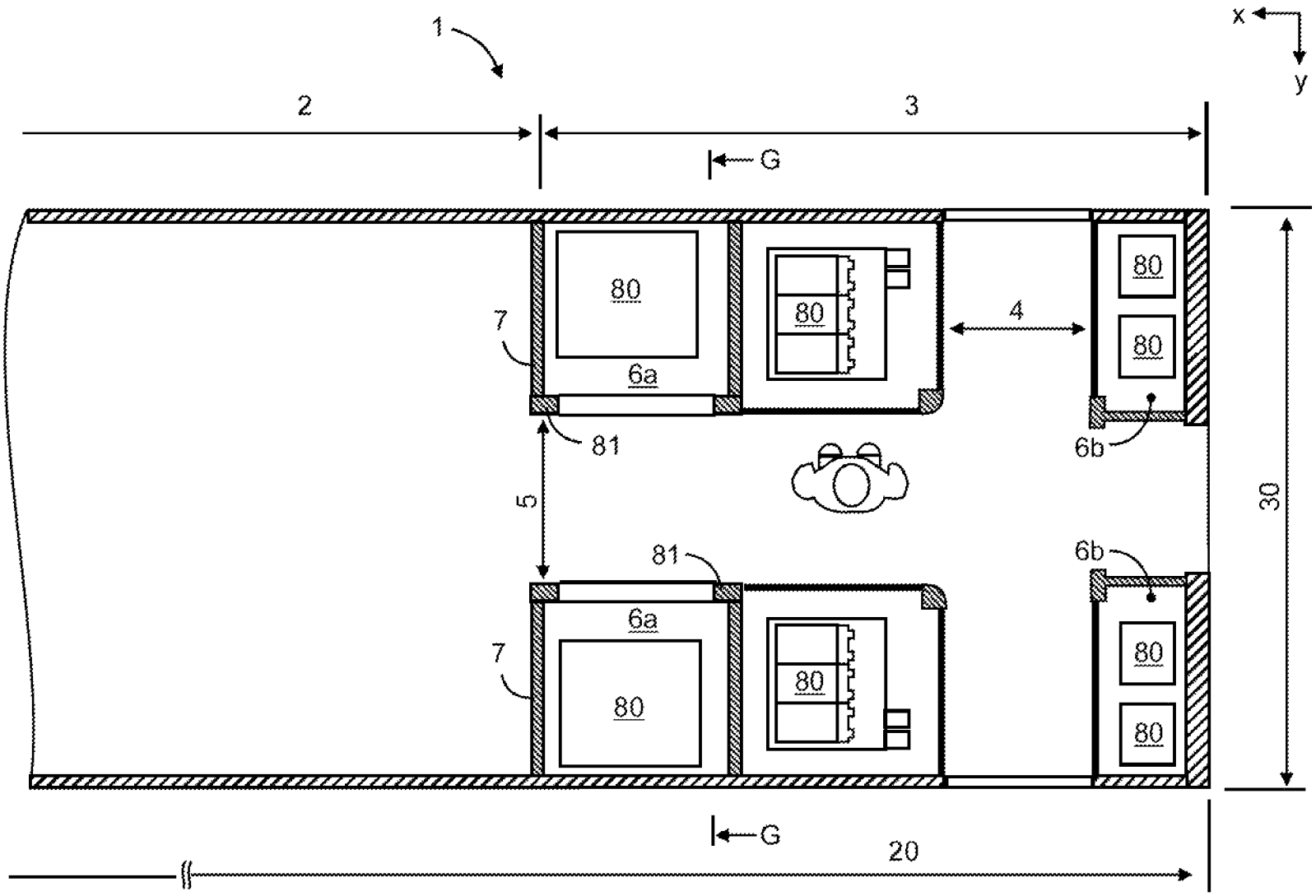
FIG. 7 is a horizontal cross-sectional view (a cross-sectional view taken along a line B-B in FIG. 1) showing a vehicle end portion of the railway vehicle.
Figure 8:
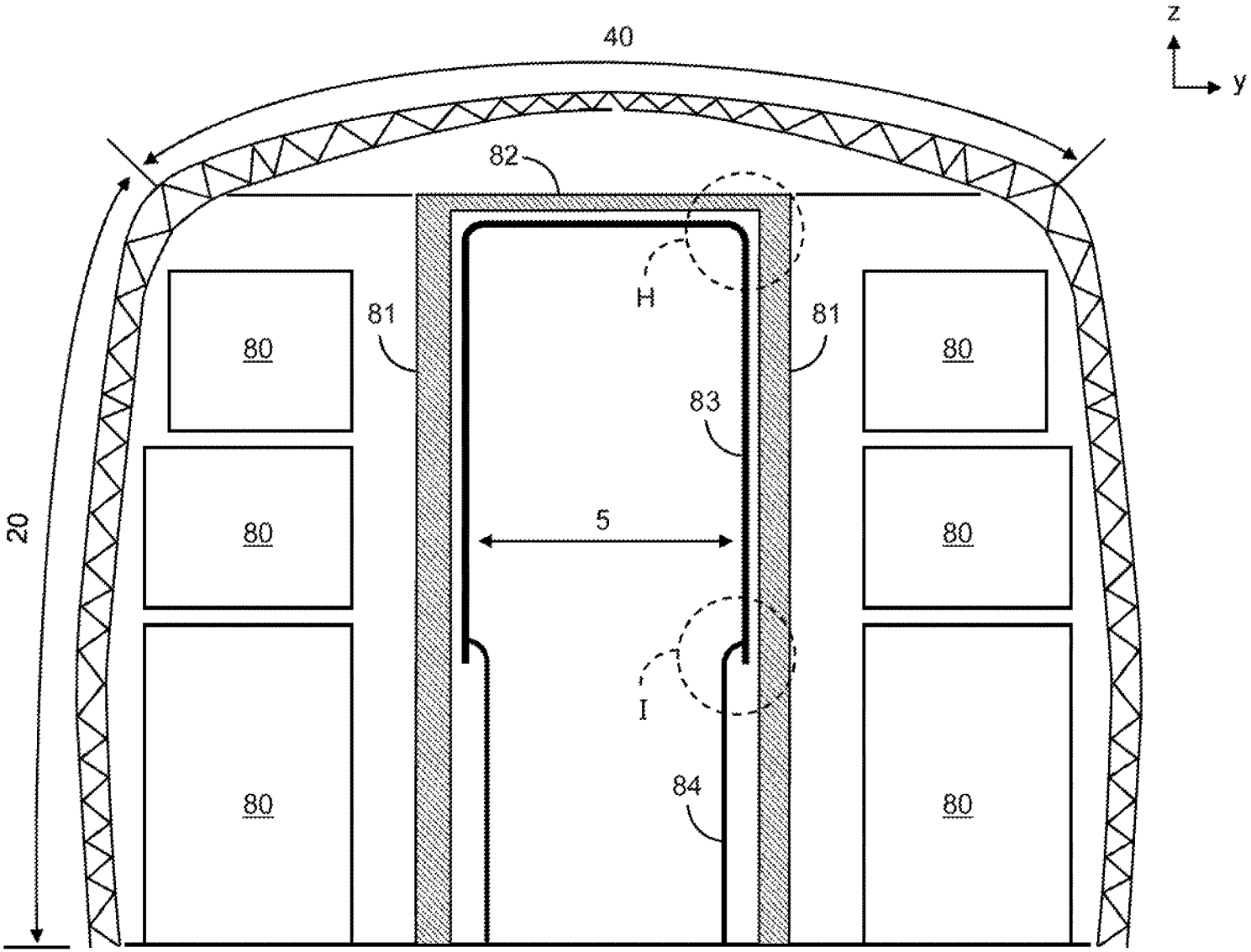
FIG. 8 is a cross-sectional view (a cross-sectional view taken along a line G-G in FIG. 7) intersecting a longitudinal direction of the vehicle end portion of the railway vehicle.
Figure 9:
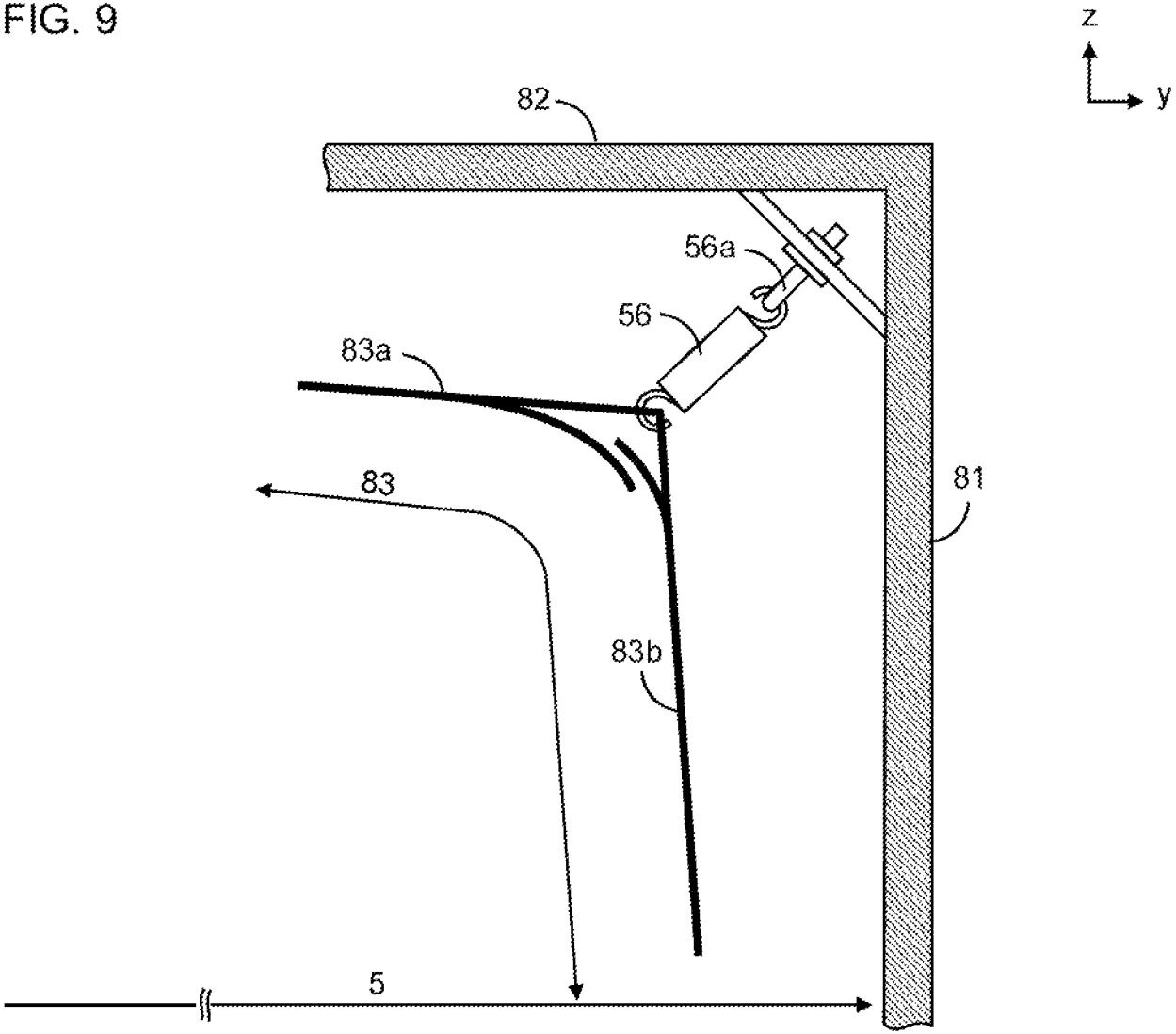
FIG. 9 is a cross-sectional view (a part H in FIG. 8) intersecting a longitudinal direction of an upper end portion of a vehicle-end-portion passage of the railway vehicle.
Figure 10:
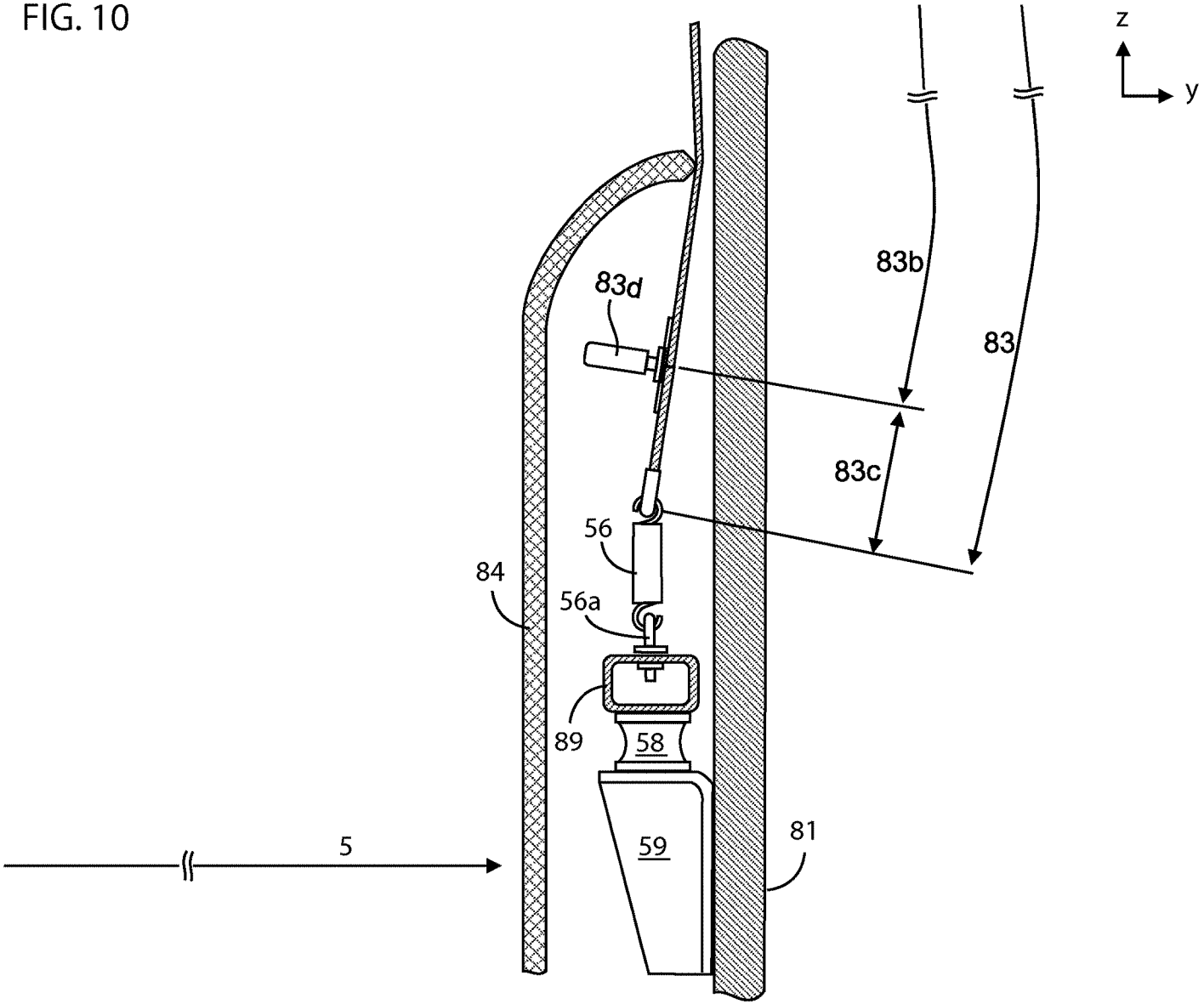
FIG. 10 is a cross-sectional view (a part I in FIG. 8) intersecting a longitudinal direction of a side wall of the vehicle-end-portion passage of the railway vehicle.

FIG. 7 is a horizontal cross-sectional view (a cross-sectional view taken along a line B-B in FIG. 1) showing a vehicle end portion of the railway vehicle, and FIG. 8 is a cross-sectional view (a cross-sectional view taken along a line G-G in FIG. 7) intersecting a longitudinal direction of the vehicle end portion of the railway vehicle. FIG. 9 is a cross-sectional view (a part H in FIG. 8) intersecting a longitudinal direction of an upper end portion of a vehicle-end-portion passage of the railway vehicle, and FIG. 10 is a cross-sectional view (a part I in FIG. 8) intersecting a longitudinal direction of a side wall of the vehicle-end-portion passage of the railway vehicle.

The railway vehicle 1 includes the cabin portion 2 at the central portion in the x direction of the railway vehicle 1, and the vehicle end portion 3 at the end portion in the x direction of the railway vehicle 1. The cabin portion 2 and the vehicle end portion 3 are partitioned by inner ends 7, seats and the like are provided in the cabin portion 2, and device rooms 6*a* and 6*b* in which various devices 80 are disposed, a boarding gate through which a passenger or the like boards and gets off the railway vehicle 1, and an entrance stand 4 and the vehicle-end-portion passage 5 that connect the boarding gate and the cabin portion 2, and the like are provided in the vehicle end portion 3.

Although not shown, the inner end 7 includes a partition member having a heat insulating property and a sound insulating property, and an inner end film that covers a surface of the partition member on the cabin portion 2 side. The partition member includes an upper end receiving portion that supports the inner end film at an upper end portion of the partition member and a lower end receiving portion that supports the inner end film at a lower end portion of the partition member.

Similar to the side film 22, the inner end film has an inner end film central portion, an inner end film end portion connected to the partition member via an elastic body, and a third fastener portion that connects the inner end film central portion and the inner end film end portion and can be opened, closed, and separated. An end portion in a height direction of the inner end film end portion is connected to the upper end receiving portion, and an end portion in a height direction of the inner end central portion is connected to the lower end receiving portion via an elastic body. In this case, the partition member of the inner end is provided in a state in which the inner end film is constantly stretched and tension is applied by the elastic body. When the third fastener portion is closed, tension of the elastic body is applied to the inner end film.

The vehicle end portion 3 in the x direction of the railway vehicle 1 is provided with the device rooms 6*b* in which various devices 80 are accommodated. The vehicle-end-portion passage 5 extending along the x direction of the railway vehicle 1 is provided between device rooms 6*a* that face the side structure 20. The device rooms 6*b* are disposed at positions facing the end structure 30 of the railway vehicle 1, and the entrance stand 4 that serves as a passage when a passenger or the like boards and gets off the railway vehicle 1 from a platform or the like is provided between the device room 6*b* that faces the end structure 30 and the device room 6*a* that faces the side structure 20.

The vehicle-end-portion passage 5 includes a pair of vehicle-end-portion pillars 81, a vehicle end portion beam 82 that connects upper end portions of the vehicle-end-portion pillars 81, a vehicle-end-portion film 83 that covers upper portions of the vehicle-end-portion pillars 81 and the vehicle end portion beam 82, and vehicle-end-portion panels 84 that cover lower end portions of the vehicle-end-portion film 83 and lower portions of the vehicle-end-portion pillars 81.

As shown in FIGS. 9 and 10, the vehicle-end-portion film 83 includes a ceiling film 83*a* that covers a ceiling of the vehicle-end-portion passage 5, vehicle-end-portion side films 83*b* that hang down from both end portions in the y direction of the ceiling film 83*a*, and side film end portions 83*c* connected to lower end portions of the vehicle-end-portion side films 83*b* via fastener portions (also referred to as second fastener portions) 83*d* that can be opened, closed, and separated. The ceiling film 83*a* and the vehicle-end-portion side film 83*b* may be formed as an integrated body (a vehicle-end-portion film central portion) having a cross-sectional shape of a horse shoe shape (a U shape) intersecting with the vehicle-end-portion passage 5, or may be formed in a manner of being separable by connecting the ceiling film 83*a* and the vehicle-end-portion side film 83*b* with a different fastener portion.

A connection portion between the ceiling film 83*a* and the vehicle-end-portion side film 83*b* is connected to one end portion of the elastic body 56, and the other end portion of the elastic body 56 is connected to an intersection portion between the vehicle end portion beam 82 and the vehicle-end-portion pillar 81 via the elastic body support portion 56*a*. An end portion in the y direction of the ceiling film 83*a* and an upper end portion in the z direction of the vehicle-end-portion side film 83*b* may be formed in a manner of covering up the elastic body 56 in a state in which the end portion in the y direction of the ceiling film 83*a* and the upper end portion in the z direction of the vehicle-end-portion side film 83*b* overlap each other.

The elastic body 56 is connected to a lower end portion of the side film end portion 83*c*, and the elastic body 56 is fixed via the elastic body support portion 56*a* to a film fixing portion 89 that is supported in a vibration proof manner via the vibration-proof rubber 58 on an upper surface of the vibration-proof rubber support portion 59 fixed to a passage side of the vehicle-end-portion pillar 81.

The vehicle-end-portion panel 84 is provided in a manner of covering up a lower end portion of the vehicle-end-portion side film 83*b*, the fastener portion 83*d*, the side film end portion 83*c*, the elastic body 56, the film fixing portion 89, the vibration-proof rubber 58, the vibration-proof rubber support portion 59, and the vehicle-end-portion pillar 81.

An upper end in the z direction of the vehicle-end-portion panel 84 is preferably bent in a manner of coming closer to the vehicle-end-portion pillar 81 than a center in the y direction of the film fixing portion 89. Accordingly, the upper end of the vehicle-end-portion panel 84 comes into contact with the vehicle-end-portion side film 83*b*, and the vehicle-end-portion side film 83*b* can be displaced so as to approach the vehicle-end-portion panel 84, and an available vehicle interior space can be increased.

When the vehicle-end-portion pillar 81 constituting the vehicle-end-portion passage 5 does not vibrate like the roof structure 40 or the side structure 20 which is likely to vibrate due to a vehicle external pressure fluctuation, the vibration-proof rubber 58 and the film fixing portion 89 may be omitted, and the other end portion of the elastic body 56 to which the side film end portion 83*c* is connected may be directly connected to a component corresponding to the vibration-proof rubber support portion 59.

<Effects>

Since an upper portion of the vehicle-end-portion passage 5 of the railway vehicle 1 is covered with the vehicle-end-portion film 83 having a small number of components, easy construction can be achieved with a small number of manufacturing steps. Further, since the vehicle-end-portion side film 83*b* and the side film end portion 83*c* of the vehicle-end-portion film 83 are connected via the fastener portion 83*d*, the vehicle-end-portion side film 83*b* (the ceiling film 83*a* may be included) can be easily replaced by opening, closing, and separating the fastener portion 83*d* when the vehicle-end-portion film 83 needs to be replaced due to deterioration or the like caused by aging.

Further, the vehicle-end-portion film 83 can be maintained in a constantly stretched state by supporting the side film end portion 83*c* at a lower end portion of the vehicle-end-portion film 83 with the elastic body 56. Therefore, even when the vehicle-end-portion film 83 expands and contracts due to aging or a change in a vehicle interior temperature, a state in which the vehicle-end-portion film 83 is constructed can be constantly maintained.

Further, even when the vehicle-end-portion pillar 81 constituting the vehicle-end-portion passage 5 vibrates when the railway vehicle 1 travels at a high speed, since the vehicle-end-portion film 83 is supported in a vibration proof manner by the vehicle-end-portion pillar 81 constituting the vehicle-end-portion passage 5, a vibration of the vehicle-end-portion film 83 is restricted, and thus an increase in vehicle interior noises can be prevented.

According to the above configuration, it is possible to provide a rail vehicle including a film that can prevent an increase in vehicle interior noises during high-speed traveling, can maintain a construction state without being affected by expansion and contraction or the like of the film due to aging, and further can be easily constructed and replaced, in addition to being able to promote a weight reduction by reducing the number of components.

<Configuration of Vehicle-End-Portion Film Having Inspection Opening Portion>

Figure 11:
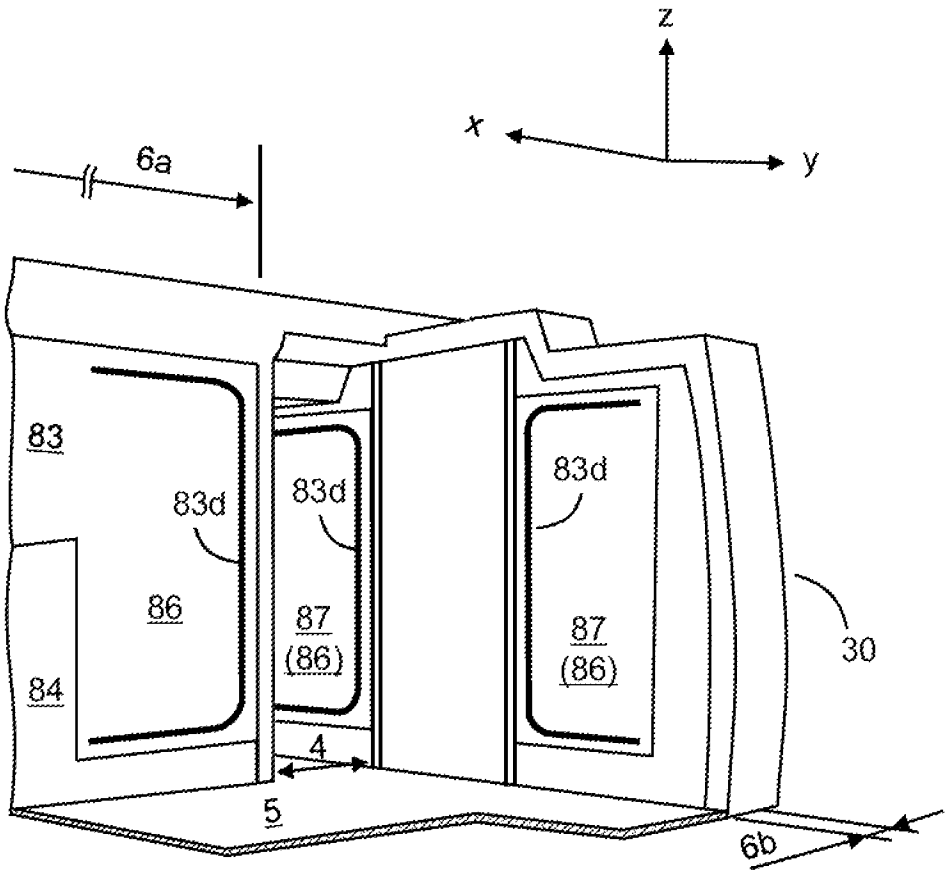
FIG. 11 is a perspective view showing the vehicle-end-portion passage of the railway vehicle.
Figure 12:
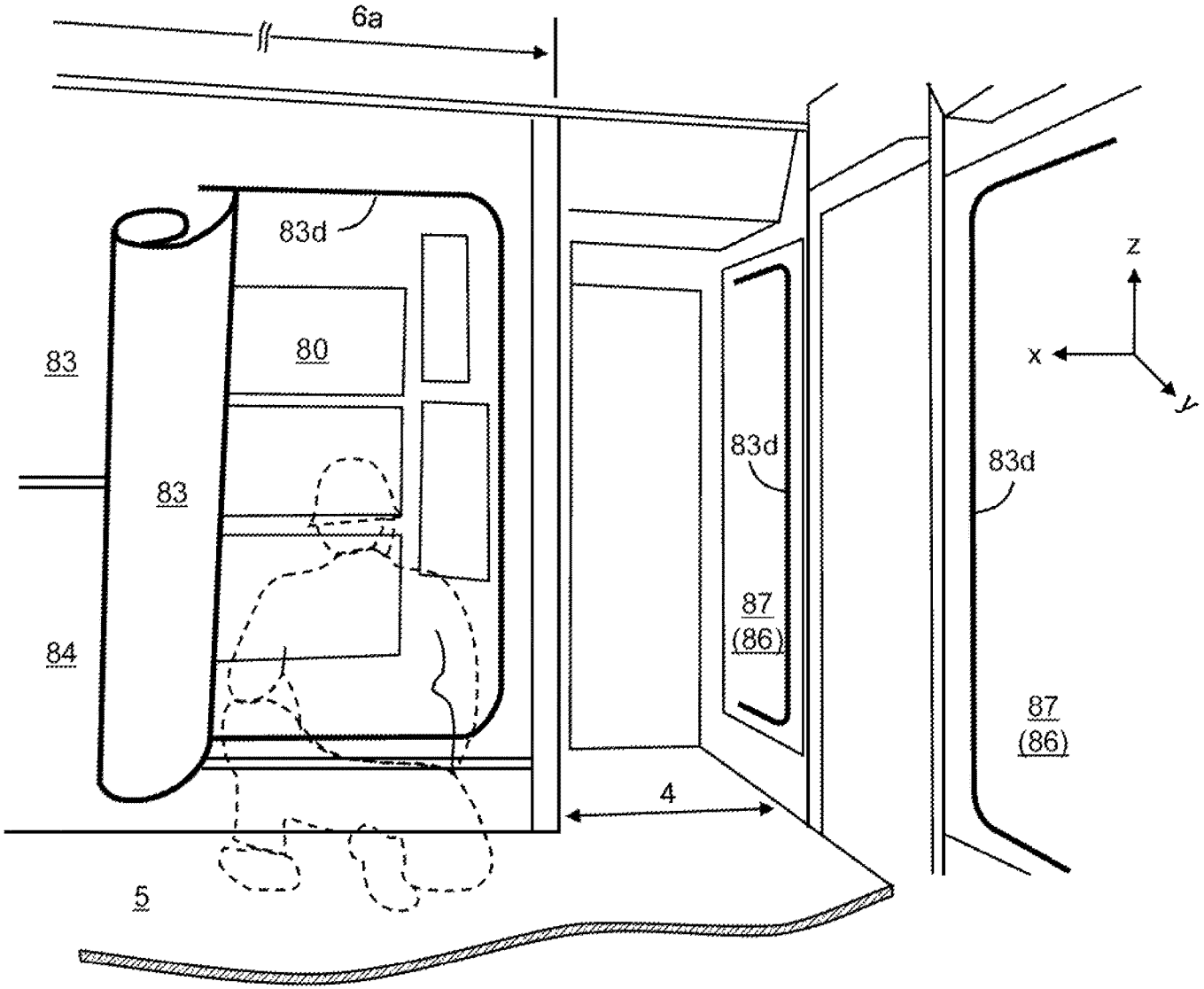
FIG. 12 is a perspective view showing a state in which an inspection opening portion of a vehicle-end-portion film of a device room that faces the vehicle-end-portion passage of the railway vehicle is opened.

FIG. 11 is a perspective view showing the vehicle-end-portion passage of the railway vehicle, and FIG. 12 is a perspective view showing a state in which an inspection opening portion of a vehicle-end-portion film of a device room that faces the vehicle-end-portion passage of the railway vehicle is opened.

Here, an example is shown in which an inspection opening portion 86 is provided in the vehicle-end-portion film 83 that partitions the device room 6*a* of the vehicle end portion 3 from the vehicle-end-portion passage 5, and is provided in a device room film 87 that partitions the device room 6*b* from the entrance stand 4.

Although not shown, the device room film 87 is partitioned into a central portion and an end portion by a fastener portion, and the end portion is connected to the end structure 30 via an elastic body in a similar manner to that in the above-described embodiment, and thus the device room film 87 is maintained in a state of being constantly stretched. Therefore, even when the device room film 87 expands and contracts due to an influence of aging or a vehicle interior environment, since the elastic body constantly applies tension, the device room film 87 does not wrinkle or sag, and maintains a newly manufactured state.

Here, the inspection opening portion 86 is defined by the fastener portion 83*d* in an openable and closable manner in a central portion of the vehicle-end-portion side film 83*b* of the vehicle-end-portion film 83 or the device room film 87. The openable, closable, and separable fastener portion 83*d* is continuously provided in a substantially U shape including an upper side, a lower side, and a vertical side that connects one end portion of the upper side and one end portion of the lower side. Therefore, the other end portion of the upper side and the other end portion of the lower side of the inspection opening portion 86 are in a connected state, even when the fastener portion 83*d* is fully opened, the central portions of the vehicle-end-portion film 83 and the device room film 87 are in a state in which the central portions can be opened on one side, and are not detached. Alternatively, the central portions of the vehicle-end-portion film 83 and the device room film 87 may be separated completely by the fastener portion 83*d* as needed so that only the central portions can be easily replaced.

When the devices 80 accommodated in the device rooms 6*a* and 6*b* are to be inspected, the inspection opening portion 86 can be easily unfolded around an axis that is the vertical side connecting the other end portion of the upper side and the other end portion of the lower side of the inspection opening portion 86 by opening the fastener portion 83*d* only without using a tool or the like, and accordingly, an operator can easily access the devices 80.

<Effects>

By providing the inspection opening portion 86 that is defined by the fastener portion 83*d* in an openable and closable manner in the vehicle-end-portion film 83 or the device room film 87, it is not necessary to provide the inspection opening portion 86 as a separate component, and the inspection opening portion 86 having a large opening area can be provided with a small number of components.

Further, since the inspection opening portion 86 is defined by the fastener portion 83*d*, the inspection opening portion 86 can be opened and closed in a short time by opening and closing the fastener portion 83*d* without preparing an opening and closing tool or the like.

Further, the inspection opening portion 86 can be opened to one side, by opening the fastener portion 83*d*, around an axis that is the vertical side connecting the other end portion of the upper side and the other end portion of the lower side of the inspection opening portion 86, and thus the opened inspection opening portion 86 can be wound around the axis. Therefore, different from an inspection lid which is a separate component and has a large area and a large weight in the related art, the inspection opening portion 86 formed of a lightweight film does not have a trouble of placement during inspection.

According to the above configuration, it is possible to provide a rail vehicle including a film that can prevent an increase in vehicle interior noises during high-speed traveling, can maintain a construction state without being affected by expansion and contraction or the like of the film due to aging, and further can be easily constructed, replaced, and has an openable and closable inspection opening, in addition to being able to promote a weight reduction by reducing the number of components.

The present specification includes the following disclosure of inventions.

First Aspect

A rail vehicle includes: a structure, in which the structure includes a film provided along the structure on a vehicle inner side of the rail vehicle, the film has a film central portion, a film end portion connected to the structure via an elastic body, and a first fastener portion that separably connects the film central portion and the film end portion, and tension of the elastic body is applied to the film in a state in which the first fastener portion is closed.

Second Aspect

In the rail vehicle according to the first aspect, the structure is a roof structure, the film is a ceiling film, the ceiling film has a ceiling film central portion protrusion portion that protrudes toward the roof structure side at a central portion in a width direction of the ceiling film, the ceiling film central portion protrusion portion is gripped by a gripping portion of a central portion holding portion supported by the roof structure in a vibration proof manner, and one end portion of the elastic body is connected to the film end portion of the ceiling film, and the other end portion of the elastic body is connected to a first film and sound absorbing material support portion supported by the roof structure in a vibration proof manner.

Third Aspect

In the rail vehicle according to the second aspect, a first sound absorbing material support plate that supports a sound absorbing material is provided between the roof structure and the ceiling film, a central portion in a width direction of the first sound absorbing material support plate is supported by the central portion holding portion, and an end portion in the width direction of the first sound absorbing material support plate is supported by the first film and sound absorbing material support portion.

Fourth Aspect

In the rail vehicle according to any one of the first to third aspects, the structure is a side structure, the film is a side film, an end portion in a height direction of the side film is connected to a second film and sound absorbing material support portion of a luggage receiving portion supported by the side structure in a vibration proof manner, and the other end portion in the height direction of the side film is connected to a third film and sound absorbing material support portion supported by the side structure in a vibration proof manner.

Fifth Aspect

In the rail vehicle according to the fourth aspect, a second sound absorbing material support plate that supports a sound absorbing material is provided between the side structure and the side film, one end portion in a height direction of the second sound absorbing material support plate is connected to the second film and sound absorbing material support portion, and the other end portion in the height direction of the second sound absorbing material support plate is connected to the third film and sound absorbing material support portion.

Sixth Aspect

In the rail vehicle according to any one of the first to fifth aspects, the rail vehicle includes a device room in which a device is disposed along the side structure and a vehicle-end-portion passage that faces the device room, and the vehicle-end-portion passage includes a pair of pillars, a beam that connects upper end portions of the pillars, a U-shaped vehicle-end-portion film that partitions an upper portion of the vehicle-end-portion passage and the device room and intersects a longitudinal direction of the vehicle-end-portion passage, and a vehicle-end-portion panel that covers a lower end portion of the vehicle-end-portion film and partitions the vehicle-end-portion passage and the device room.

Seventh Aspect

In the rail vehicle according to the sixth aspect, an end portion of the vehicle-end-portion film covered by the vehicle-end-portion panel is connected to the pillar via an elastic body.

Eighth Aspect

In the rail vehicle according to the seventh aspect, the vehicle-end-portion film has a vehicle-end-portion side film, a side film end portion connected to the pillar via an elastic body, and a second fastener portion that separably connect the vehicle-end-portion side film and the side film end portion.

Ninth Aspect

In the rail vehicle according to the eighth aspect, the vehicle-end-portion film facing the device room has an inspection opening portion provided for inspecting the device disposed in the device room, and the second fastener portion is provided in continuous along an upper side, a lower side, and a vertical side that connects one end portion of the upper side and one end portion of the lower side of the inspection opening portion.

Tenth Aspect

In the rail vehicle according to any one of the first to ninth aspect, the rail vehicle includes a cabin at a central portion in a longitudinal direction of the rail vehicle, a vehicle end portion at an end portion in the longitudinal direction of the rail vehicle, and an inner end that partitions the cabin and the vehicle end portion, the inner end includes a partition member and an inner end film provided on the cabin side of the partition member, the inner end film has an inner end film central portion, an inner end film end portion connected to the partition member via an elastic body, and a third fastener portion that connects the inner end film central portion and the inner end film end portion, and tension of the elastic body is applied to the inner end film in a state in which the third fastener portion is closed.

REFERENCE SIGNS LIST

1: railway vehicle
2: cabin portion
3: vehicle end portion
4: entrance stand
5: vehicle-end-portion passage
6*a*, 6*b*: device room
7: inner end
10: underframe
12: upper floor
14: seat
20: side structure
20*a*: vehicle external side plate
20*b*: vehicle inner side plate
20*c*: connection rib
20*d*: receiving portion
21: luggage receiving portion
21*a*: luggage receiving portion front side panel
21*b*: luggage receiving portion bottom portion
21*c*: second film and sound absorbing material support portion
21*d*: luggage receiving portion back side panel
21*e*: luggage receiving portion support portion
22: side film
22*b*: side film central portion
22*c*: side film end portion
22*d*: first fastener portion
24: lamp
25: side lower portion interior panel
30: end structure
40: roof structure
40*a*: vehicle external side plate
40*b*: vehicle inner side plate
40*c*: connection rib
40*d*: receiving portion
42: ceiling film
42*a*: ceiling film central protrusion portion
42*b*: ceiling film central portion
42*c*: ceiling film end portion
42*d*: first fastener portion
44: first sound absorbing material support plate
44A: second sound absorbing material support plate
46: central portion holding portion
46*a*: gripping portion
48: eaves portion interior panel
49: first film and sound absorbing material support portion

49A: third film and sound absorbing material support portion
52: heat insulating material
54: sound absorbing material
56: elastic body (coil spring)
56*a*: elastic body support portion
58: vibration-proof rubber
59: vibration-proof rubber support portion
80: device
81: vehicle-end-portion pillar
82: vehicle end portion beam
83: vehicle-end-portion film
83*a*: ceiling film
83*b*: vehicle-end-portion side film
83*c*: side film end portion
83*d*: second fastener portion
84: vehicle-end-portion panel
86: inspection opening portion
87: device room film
89: film fixing portion
90: track
x: longitudinal direction (rail direction)
y: width direction (sleeper direction)
z: height direction

The invention claimed is:

1. A rail vehicle comprising:
a structure, wherein
the structure includes a film provided along the structure on a vehicle inner side of the rail vehicle,
the film has a film central portion, a film end portion connected to the structure via an elastic body, and a first fastener portion that separably connects the film central portion and the film end portion, and
tension of the elastic body is applied to the film in a state in which the first fastener portion is closed,
the rail vehicle includes a device room in which a device is disposed along a side structure and a vehicle-end-portion passage that faces the device room, and
the vehicle-end-portion passage includes
a pair of pillars,
a beam that connects upper end portions of the pillars,
a U-shaped vehicle-end-portion film that partitions an upper portion of the vehicle-end-portion passage and the device room and intersects a longitudinal direction of the vehicle-end-portion passage, and
a vehicle-end-portion panel that covers a lower end portion of the vehicle-end-portion film and partitions the vehicle-end-portion passage and the device room.

2. The rail vehicle according to claim 1, wherein
the structure is a roof structure,
the film is a ceiling film,
the ceiling film has a ceiling film central portion protrusion portion that protrudes toward the roof structure side at a central portion in a width direction of the ceiling film,
the ceiling film central portion protrusion portion is gripped by a gripping portion of a central portion holding portion supported by the roof structure in a vibration proof manner, and
one end portion of the elastic body is connected to the film end portion of the ceiling film, and the other end portion of the elastic body is connected to a first film and sound absorbing material support portion supported by the roof structure in a vibration proof manner.

3. The rail vehicle according to claim 2, wherein
a first sound absorbing material support plate that supports a sound absorbing material is provided between the roof structure and the ceiling film,
a central portion in a width direction of the first sound absorbing material support plate is supported by the central portion holding portion, and
an end portion in the width direction of the first sound absorbing material support plate is supported by the first film and sound absorbing material support portion.

4. The rail vehicle according to claim 1, wherein
the structure is a side structure,
the film is a side film,
one end portion in a height direction of the side film is connected to a second film and sound absorbing material support portion of a luggage receiving portion supported by the side structure in a vibration proof manner, and
the other end portion in the height direction of the side film is connected to a third film and sound absorbing material support portion supported by the side structure in a vibration proof manner.

5. The rail vehicle according to claim 4, wherein
a second sound absorbing material support plate that supports a sound absorbing material is provided between the side structure and the side film,
one end portion in a height direction of the second sound absorbing material support plate is connected to the second film and sound absorbing material support portion, and
the other end portion in the height direction of the second sound absorbing material support plate is connected to the third film and sound absorbing material support portion.

6. The rail vehicle according to claim 1, wherein
an end portion of the vehicle-end-portion film covered by the vehicle-end-portion panel is connected to the pillar via an elastic body.

7. The rail vehicle according to claim 6, wherein
the vehicle-end-portion film has a vehicle-end-portion side film, a side film end portion connected to the pillar via an elastic body, and a second fastener portion that separably connect the vehicle-end-portion side film and the side film end portion.

8. The rail vehicle according to claim 7, wherein
the vehicle-end-portion film facing the device room has an inspection opening portion provided for inspecting the device disposed in the device room, and
the second fastener portion is provided in continuous along an upper side, a lower side, and a vertical side that connects one end portion of the upper side and one end portion of the lower side of the inspection opening portion.

9. The rail vehicle according to claim 1, wherein
the rail vehicle includes a cabin at a central portion in a longitudinal direction of the rail vehicle, a vehicle end portion at an end portion in the longitudinal direction of the rail vehicle, and an inner end that partitions the cabin and the vehicle end portion,
the inner end includes a partition member and an inner end film provided on the cabin side of the partition member,
the inner end film has an inner end film central portion, an inner end film end portion connected to the partition member via an elastic body, and a third fastener portion that connects the inner end film central portion and the inner end film end portion, and tension of the elastic body is applied to the inner end film in a state in which the third fastener portion is closed.

* * * * *